US010700466B2

(12) United States Patent
Brodsky et al.

(10) Patent No.: US 10,700,466 B2
(45) Date of Patent: Jun. 30, 2020

(54) DOUBLE TOUCH-SAFE CONNECTOR SYSTEM

(71) Applicant: INTERNATIONAL BUSINESS MACHINES CORPORATION, Armonk, NY (US)

(72) Inventors: William L. Brodsky, Binghamton, NY (US); Robert B. Schlak, Hyde Park, NY (US); Noah B. Singer, White Plains, NY (US); Mitchell L. Zapotoski, New Paltz, NY (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 0 days.

(21) Appl. No.: 16/175,801

(22) Filed: Oct. 30, 2018

(65) Prior Publication Data

US 2020/0136298 A1 Apr. 30, 2020

(51) Int. Cl.

| | |
|---|---|
| ***H01R 13/44*** | (2006.01) |
| ***H01R 13/453*** | (2006.01) |
| ***H01R 43/26*** | (2006.01) |
| ***H01R 13/631*** | (2006.01) |

(52) U.S. Cl.

CPC ..... *H01R 13/4538* (2013.01); *H01R 13/631* (2013.01); *H01R 43/26* (2013.01)

(58) Field of Classification Search

CPC ..... H01R 13/4534; H01R 13/4536; H01R 13/4532; H01R 13/4538; H01R 13/447

USPC ..... 439/137–142

See application file for complete search history.

(56) References Cited

U.S. PATENT DOCUMENTS

| | | | | |
|---|---|---|---|---|
| 4,963,098 A | | 10/1990 | Myer et al. | |
| 5,344,331 A | | 9/1994 | Hoffman | |
| 5,372,515 A | * | 12/1994 | Miller | H01R 13/4536 439/138 |
| 5,391,091 A | | 2/1995 | Nations | |
| 5,716,224 A | * | 2/1998 | Masuda | H01R 13/4536 439/138 |
| 6,305,955 B1 | | 10/2001 | Billman | |

(Continued)

FOREIGN PATENT DOCUMENTS

WO WO2010081011 A1 7/2010

*Primary Examiner* — Thanh Tam T Le

(74) *Attorney, Agent, or Firm* — Law Offices of Ira D. Blecker, P.C.

(57) ABSTRACT

A connector system that includes first and second connector components. The first connector component includes a female connector. The second connector component includes a male connector having blades for insertion into the female connector; an enclosure enclosing the male connector and having an open end wherein the blades of the male connector face the open end; a locked shield within the open end of the enclosure to obscure the blades and to prevent contact with the blades; and an actuator to unlock the locked shield. Upon insertion of the first connector component into the enclosure, the first connector component causes the actuator to unlock the locked shield and upon further insertion of the first connector component into the enclosure, the first connector component opens the unlocked shield away from the male connector to expose the blades and to allow the female connector to engage the blades of the male connector.

14 Claims, 8 Drawing Sheets

(56) References Cited

U.S. PATENT DOCUMENTS

| | | | | |
|---|---|---|---|---|
| 6,332,781 | B1 * | 12/2001 | Ito | H01R 13/187 439/138 |
| 6,832,923 | B2 * | 12/2004 | Sasame | H01R 13/6485 439/137 |
| 6,896,530 | B2 * | 5/2005 | Nishio | H01R 13/4534 439/137 |
| 6,908,319 | B2 * | 6/2005 | Sasame | H01R 13/4536 439/137 |
| 6,935,873 | B2 * | 8/2005 | Funatsu | H01R 13/4532 439/137 |
| 7,077,670 | B2 * | 7/2006 | Suwa | G06K 13/0875 361/679.34 |
| 7,101,202 | B2 * | 9/2006 | Fan | H01R 12/7005 439/137 |
| 7,140,892 | B2 * | 11/2006 | Takeuchi | H01R 13/4532 439/138 |
| 7,537,468 | B1 * | 5/2009 | Huang | H01R 13/4536 439/135 |
| 7,618,272 | B2 | 11/2009 | Cheng | |
| 8,425,243 | B2 * | 4/2013 | Alvarez Rivera | H01R 13/447 439/142 |
| 8,545,275 | B2 | 10/2013 | Wang et al. | |
| 9,287,665 | B2 | 3/2016 | Watanabe | |
| 9,601,861 | B2 * | 3/2017 | Kanamori | H01R 13/4532 |
| 2016/0104962 | A1 | 4/2016 | Lee | |

* cited by examiner

DOUBLE TOUCH-SAFE CONNECTOR SYSTEM

BACKGROUND

The present exemplary embodiments pertain to a connector system and, more particularly, pertain to a connector system which is a double touch-safe connector system and which may be also a blind mate connector system.

UL (Underwriting Laboratories) and other safety standards use a particular criterion to determine the "touch safe" compliance of electrical components. "Touch safe" meaning safe to touch without fear of electrical shock. Since electrical connectors are used in electrical circuits and when unplugged my still have an applied voltage there is a requirement for the connector contacts to be "touch-safe". A feature of a back-up battery or uninterruptible power supply is both sides of the mating connector pairs may be energized: one side by the charging circuit, the other by the battery creating a potentially hazardous situation when the battery and charging circuit are separated by a separable connector.

Two piece connectors are typically comprised of a "male" side and a "female" side where the female side is more readily made touch-safe while the male side is typically more difficult to address. For two piece connectors, the female connector is commonly used on the unit which is outputting/sourcing power (for example, a wall outlet in a house) and the male connector is typically used on the unit which is inputting/sinking power (for example, a lamp, tool, heater, etc). However, in certain cases, for example, connecting a battery backup unit to a power supply unit, both sides may potentially be outputting dangerous levels of power. In this scenario, a "double touch-safe" connector system is required, wherein both sides of the connector are touch-safe and/or are physically shielded as potential shock hazards.

It may also be a requirement of two piece connectors that they be "blind mated" which means that the two pieces of the connectors may be joined without visual alignment.

BRIEF SUMMARY

The various advantages and purposes of the exemplary embodiments as described above and hereafter are achieved by providing, according to an aspect of the exemplary embodiments, a connector system comprising: a first connector component comprising a female connector; a second connector component comprising: a male connector having blades for insertion into the female connector; an enclosure enclosing the male connector and having an open end such that the blades of the male connector face the open end; a locked shield within the open end of enclosure to obscure the blades and to prevent contact with the blades; an actuator to unlock the locked shield; wherein, in operation, upon insertion of the first connector component into the enclosure, the first connector component causes the actuator to unlock the locked shield and upon further insertion of the first connector component into the enclosure, the first connector component opens the unlocked shield away from the male connector to expose the blades and to allow the female connector to engage the blades of the male connector According to another aspect of the exemplary embodiments, there is provided a connector system comprising: a male connector component comprising: a male connector having blades for insertion into a female connector; a first enclosure enclosing the male connector and having an open end such that the blades of the male connector face the open end; a first aligner on an exterior of the first enclosure; a locked shield within the open end of the first enclosure to obscure the blades and to prevent contact with the blades; a first actuator and a second actuator attached to the first enclosure to unlock the locked shield. The connector system further includes a female connector component comprising: a female connector; a second enclosure enclosing the female connector and having an open end in which the female connector is exposed; a second aligner on an exterior of the second enclosure; wherein, in operation, upon insertion of the female connector component into the first enclosure to slideably engage the first aligner with the second aligner to cause alignment of the first enclosure and the second enclosure, the second enclosure causes the first and second actuators to together unlock the locked shield and upon further insertion of the female connector component into the first enclosure, the second enclosure opens the unlocked shield away from the male connector to expose the blades and to allow the female connector to engage the blades of the male connector.

According to a further aspect of the exemplary embodiments, there is provided a method of joining components of a connector system comprising: a first connector component comprising a female connector; a second connector component comprising: a male connector having blades for insertion into the female connector; an enclosure enclosing the male connector and having an open end such that the blades of the male connector face the open end; a locked shield within the open end of enclosure to obscure the blades and to prevent contact with the blades; and an actuator to unlock the locked shield. The method comprising the steps of: partially inserting the first connector into the enclosure, the first connector component causing the actuator to unlock the locked shield; fully inserting the first connector component into the enclosure, the first connector component opening the unlocked shield away from the male connector to expose the blades; engaging the female connector and the blades of the male connector.

BRIEF DESCRIPTION OF SEVERAL VIEWS OF THE DRAWINGS

The features of the exemplary embodiments believed to be novel and the elements characteristic of the exemplary embodiments are set forth with particularity in the appended claims. The Figures are for illustration purposes only and are not drawn to scale. The exemplary embodiments, both as to organization and method of operation, may best be understood by reference to the detailed description which follows taken in conjunction with the accompanying drawings in which:

DETAILED DESCRIPTION

Figure 1:
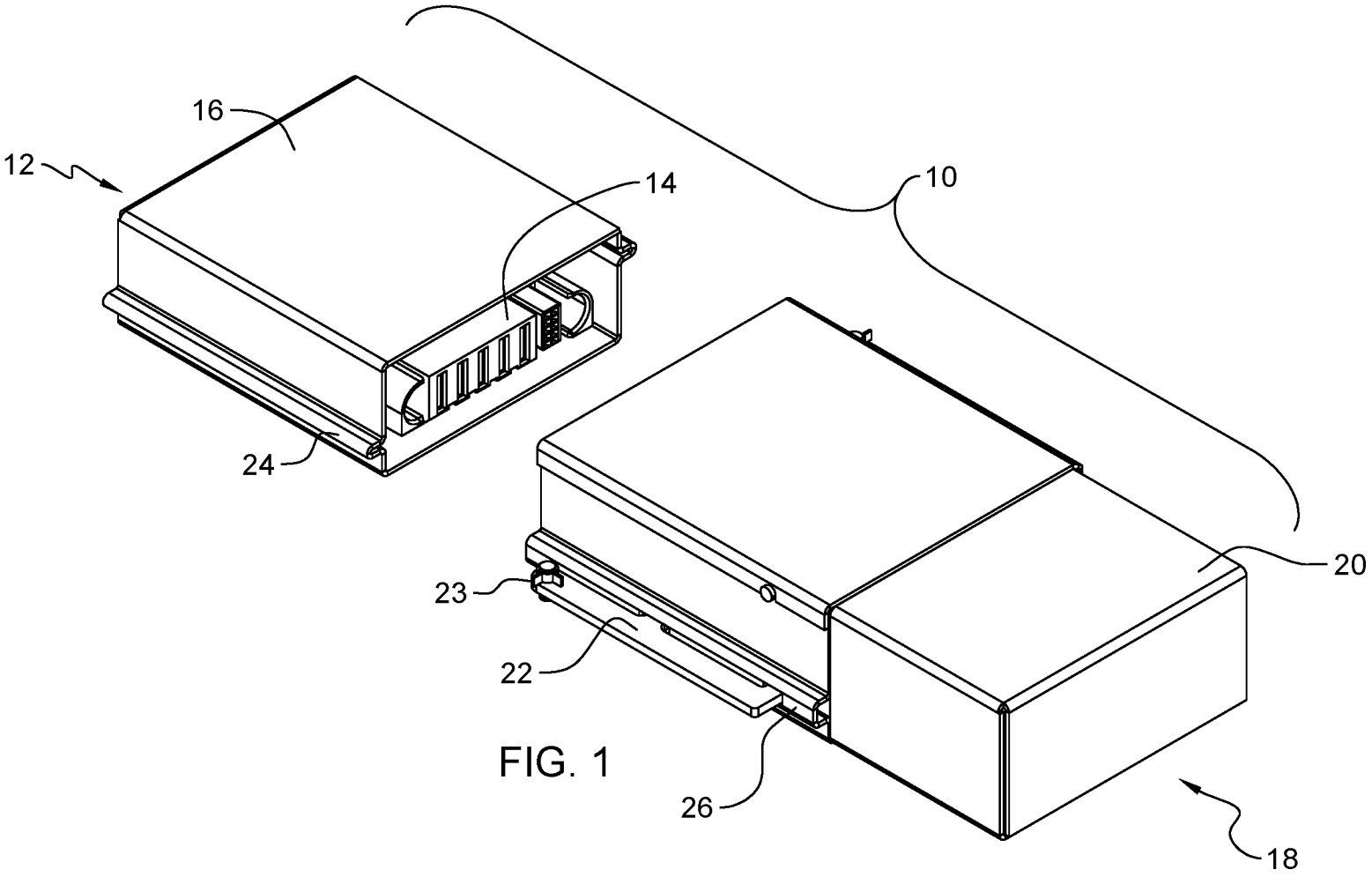
FIG. 1 illustrates an exemplary embodiment of a connector system.

In one exemplary embodiment, the connector system may be double touch-safe. In another exemplary embodiment, the connector system may be capable of being blind mated in addition to being double touch-safe.

The double touch-safe connector system of the exemplary embodiments is a mechanical assembly which automatically shields the male (non-touch-safe) side of the connector pair when the male and female connectors are not connected. By shielding the male side of the connector system when it is not connected with the female side, a double touch-safe connector system may be created. It is assumed that the female side is already touch-safe, such as would be the case with a household electrical outlet, for example.

An advantage of the exemplary embodiments is that by using a mechanical assembly to shield the male side of the connector system, a wide variety of connector types may be configured in a touch-safe arrangement. Additionally, this connector system may allow for simple blind-mating of the connector pair. Finally, the connector system of the exemplary embodiments provides mechanical strength to the connection and helps prevent issues wherein the connectors can become damaged or disconnected due to excessive forces or vibrations.

The double touch-safe connector system of the exemplary embodiments may be extended to other safety critical applications such as high temperature and large vibration applications which still need to be accessible by a mating connector. Additionally, the double touch-safe connector system of the exemplary embodiments may protect users from arc flash or pinch points in situations with movable objects, is scalable and may be configured to satisfy a wide range of safety and size requirements.

In brief, the connector system of the exemplary embodiments includes an enclosure containing the female connector which slides into a second enclosure which contains the male connector. The male connector is shielded so as to be touch-safe behind a door assembly which is locked until activated. That is, the door unlocks and moves out of the way, when the female side enclosure is slid into the male side enclosure. The door assembly may be activated by one or more independent locking tabs which may be spaced apart to prevent common release. The locking tabs prevent the door from being unlocked except when it is impossible for a person to make contact with the non-touch-safe male connector.

One or more of the exemplary embodiments may have one or all of the following features:

enclosures around both sides of the connector system provide safety shielding;

rough alignment provided by alignment features;

a locking tab which is actuated by engaging the male side and female side enclosures to unlock a shield system;

a shielding system which is unlocked when the male side and female side enclosures begin to engage.

In addition, one or more preferred exemplary embodiments may have one or all of the following features:

dual locking tabs;

dual locking tabs are independent and both must be unlocked separately;

dual locking tabs are inside a touch-safe groove or slot so are difficult to reach;

dual locking tabs are spaced apart so ideally more than a hand span apart;

dual locking tabs are offset vertically so a flat plate would not unlock them.

Referring to the Figures in more detail, and particularly referring to FIG. 1, there is illustrated an exemplary embodiment of a connector system 10. The connector system 10 may include a connector component 12, a female connector 14 and an enclosure 16.

The connector system 10 may further include another connector component 18 and an enclosure 20. Within the enclosure 20, but not shown in FIG. 1, may be a shield and a male connector. The shield is normally in a locked position due to a first position of actuator 22 but when the actuator 22 is moved to a second position, the actuator unlocks the shield. There may be more than one actuator 22 although only one actuator 22 is shown in FIG. 1.

It is also within the scope of the exemplary embodiments for the enclosures 16, 20 to have aligners 24, 26 respectively to allow alignment of the connector components 12, 18. The aligners 24, 26 preferably are on opposite sides of the enclosures 16, 20.

In one exemplary embodiment, the connector component 12 may be a removable component, such as a field replaceable unit (FRU) while the connector component 18 may be a system level component that is not normally removable. The system side of the connector system 10 may provide a shield for the non-touch-safe male connector as mentioned above. The female connector 14 is assumed to be touch-safe and may be utilized on the removable portion of the system design.

The non-touch safe connector may be protected by two features. One feature is the shield and the other feature is the enclosures 16, 20. The enclosure 16 for the female connector 14 may be removable for the FRU while the enclosure 20 may be for the system side to enclose the male connector and is generally not removable.

Each of the enclosures 16, 20 is designed to fully enclose each of the female connector 14 and the male connector, respectively, except for openings for the front of each of the connectors. The enclosures 16, 20 also provide support for mounting of the actuator 22, shield and aligners 24, 26.

Figure 3:
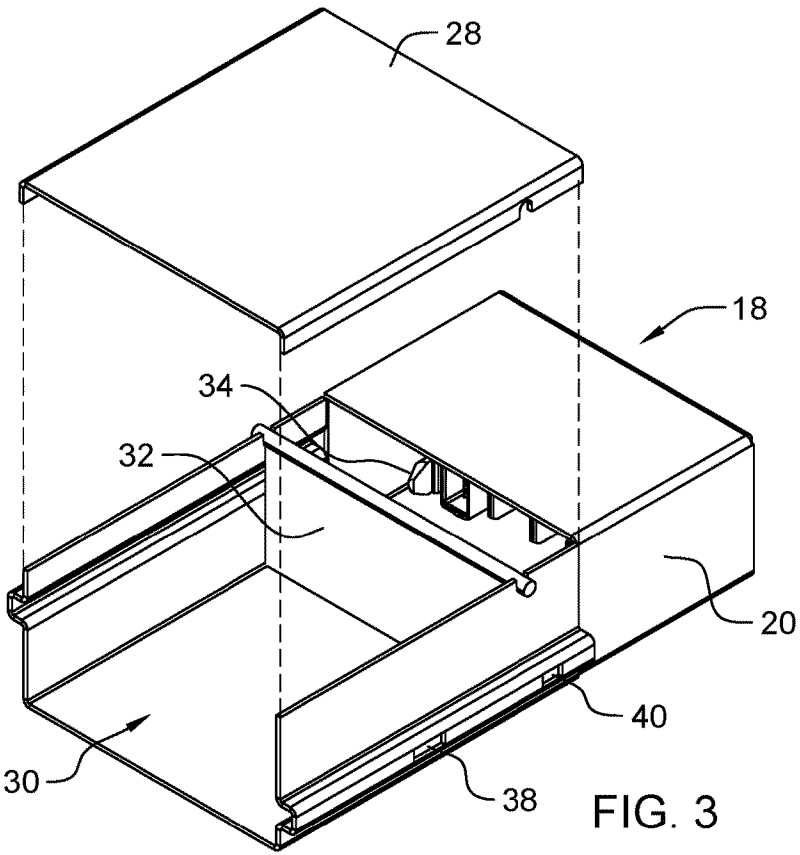
FIG. 3 illustrates the enclosure enclosing the mail connector with a cover removed to show the shield and male connector.
Figure 2:
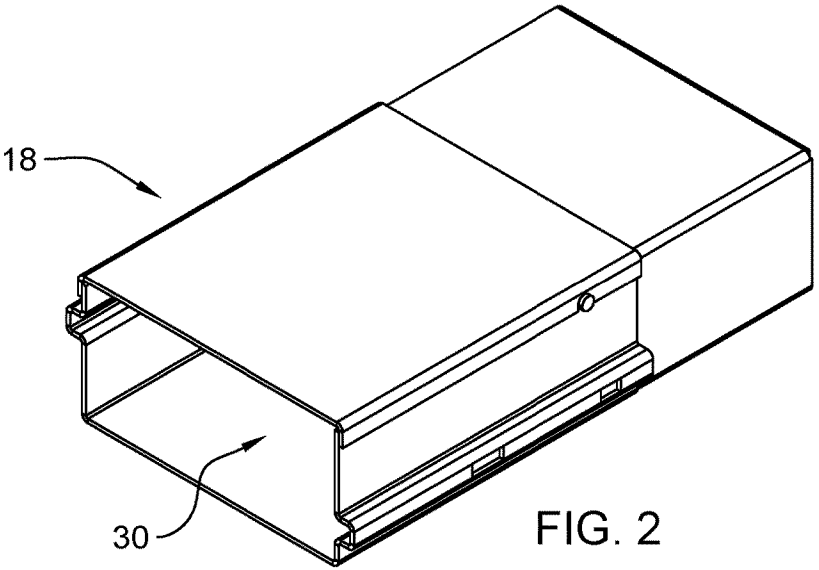
FIG. 2 illustrates the enclosure enclosing the mail connector.

Referring now to FIGS. 2 and 3, the connector component 18 is shown in greater detail. Actuator 22 has been removed for clarity. Connector component 18 may have an opening 30 for receiving connector component 12.

In FIG. 3, a cover 28 has been removed from connector component 18 to reveal the shield 32 and the male connector 34. The male connector 34 may have blades or prongs (hereafter blades). Due to the fact that the blades of male connector 34 may be electrically charged, it is a non-touch-safe connector and must be protected from inadvertent or intentional contact with humans or tools.

The enclosure 20 may have an aperture 38 for an actuating tab of the actuator 22 and an aperture for a locking tab of the actuator 22. The operation of the actuator 22 will be described in more detail hereafter.

Figure 6:
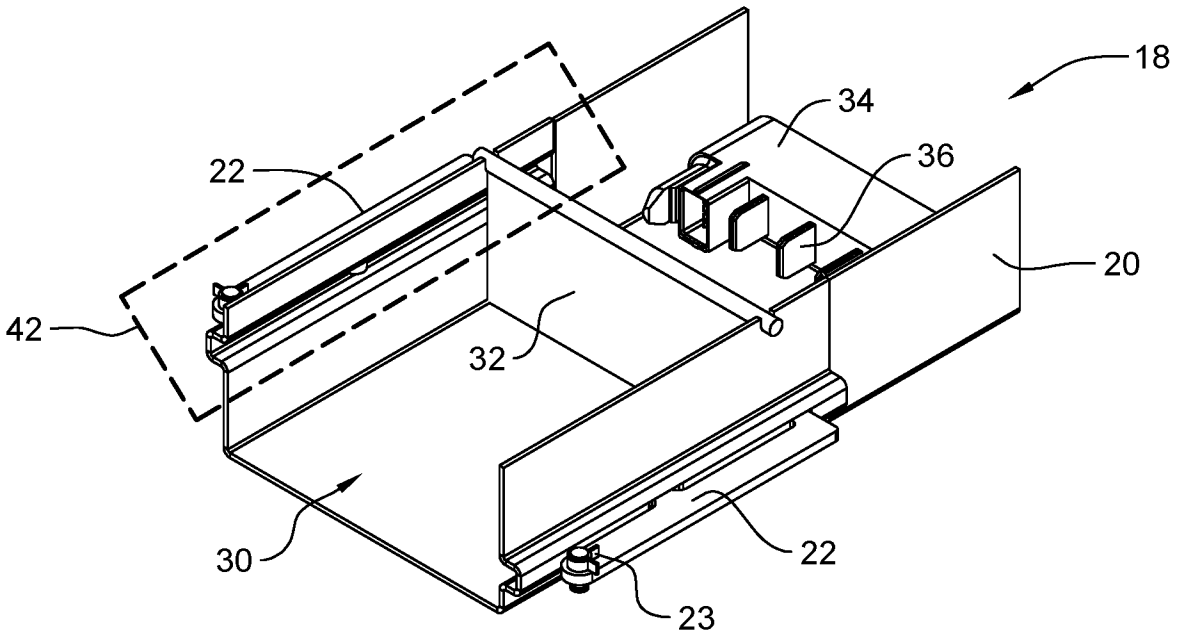
FIG. 6 illustrates the entire inside of the enclosure enclosing the shield and male connector having blades.

FIG. 6 illustrates further details of the connector component 18. Illustrated in FIG. 6 is the male connector 34 having blades 36. Also shown in FIG. 6 are actuators 22 on opposite sides of the enclosure 20.

Figure 4:
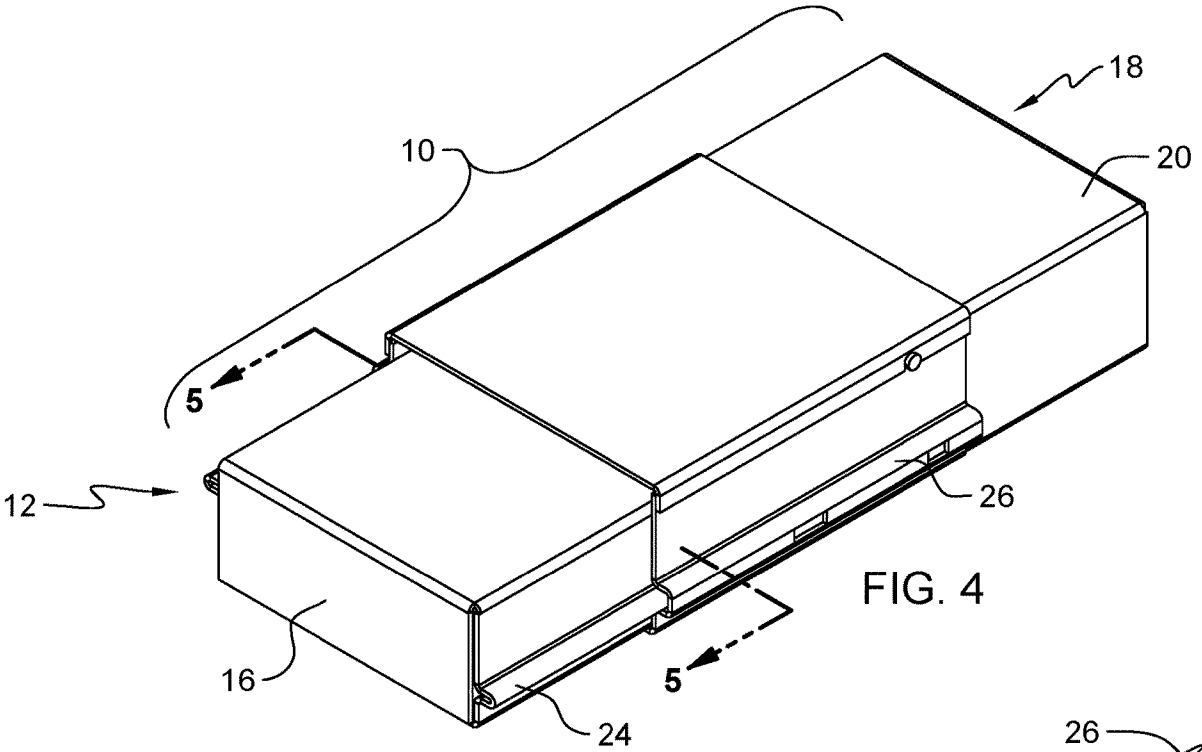
FIG. 4 illustrates the enclosure enclosing the female connector inserted in the enclosure enclosing the male connector.

Referring now to FIG. 4, connector system 10 has connector component 12 inserted into opening 30 of connector component 18. Actuator 22 has been removed for clarity. As will be explained in detail hereafter, when connector component 12 is inserted into connector component 18, the shield 32 may be unlocked and moved away from the blades of the male connector 34. Further insertion of the connector component 12 into connector component 18 will cause the engagement of the female connector 14 with the blades of the male connector 34.

Figure 5:
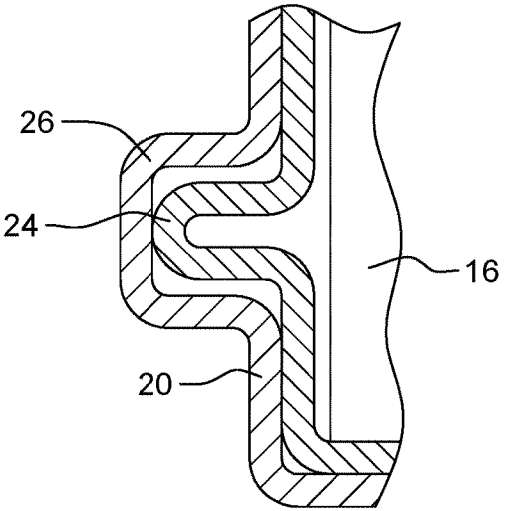
FIG. 5 is a cross sectional view in the direction of arrows A-A of FIG. 4 showing the aligners of each of the enclosures engaged.

To assist with the alignment of the connector component 12 with the connector component 18, aligner 24 is slideably engaged with the aligner 26. FIG. 5 is a cross-sectional view in the direction of arrows A-A showing aligner 24 slideably engaged with aligner 26.

The aligners 24, 26 provide the connector system 10 with its blind mate capability by bringing the connector components 12, 18 together within the gatherability of the connector components alignment system. The gatherability is the range of connector pair offset which may still allow for mating. The exemplary embodiments use two rough alignment features, the aligners 24, 26, which bring the connector components 12, 18 within their gatherability consistently by sliding the aligners 24 of the connector component 12 into matching but slightly larger aligners 26 on the connector component 18. The channels of the aligners 24, 26 shown in the Figures are one example of an alignment mechanism to align the connector components 12, 18. Other alignment mechanisms are within the scope of the exemplary embodiments.

Figure 7:
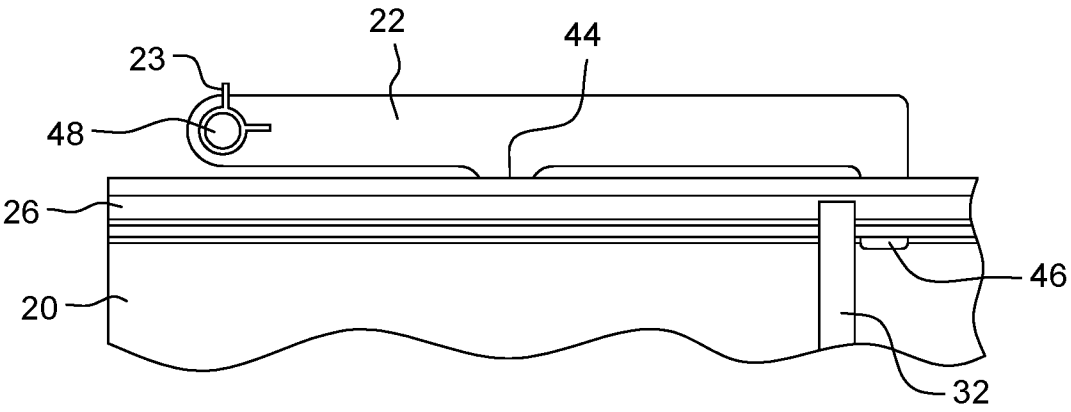
FIG. 7 illustrates an enlarged portion of FIG. 6 circumscribed by the box 42 in FIG. 6.

FIG. 7 is an enlarged plan view of the portion of connector component 18 within the dashed lines 42 shown in FIG. 6 showing the actuator 22 in relation to the shield 32. Actuator 22 has an actuating tab 44 and a locking tab 46. The actuator 22 may pivot about pin 48 which may be attached to the enclosure 20. When the actuator 22 is in the position shown in FIG. 7, the actuating tab 44 is positioned within aperture 38 of enclosure 20 and locking tab 46 is positioned within aperture 40 of enclosure 20. The locking tab 46 prevents the shield from opening so that when the locking tab 46 is within aperture 40, the shield is locked.

The locking tab on actuator 22 is concealed within the enclosure 20 to lock and unlock the shield 32 which blocks a person from reaching the non-touch-safe blades 36 of the male connector 34.

Figure 8:
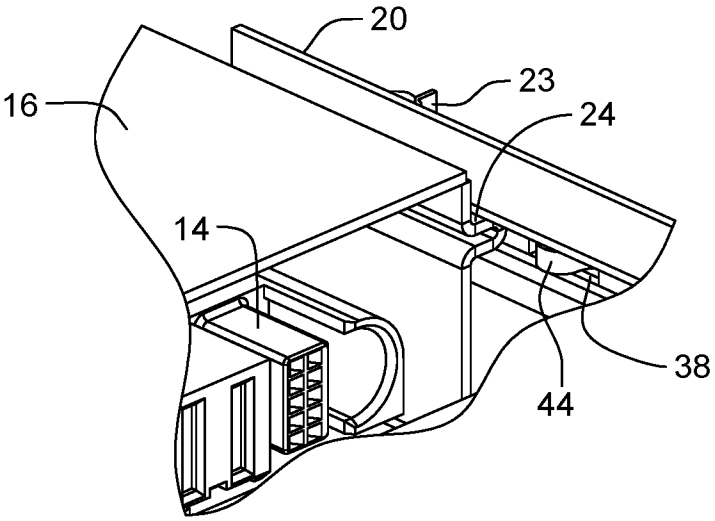
FIG. 8 illustrates in greater detail the insertion of the enclosure housing the female component into the enclosure housing the male component.

The locking tab 46 may be unlocked by inserting the enclosure 16 with the female connector 14 which allows the shield 32 to rotate open so the male and female connectors 34, 14 may engage while preventing human contact of the hazardous voltage components. Referring to FIG. 8, enclosure 16 having the female connector 14 (not shown in FIG. 8) is being inserted into the enclosure 20 having the male connector 34. When the enclosure 16 is sufficiently inserted within enclosure 20, the enclosure 16 will push actuating tab 44 out of the aperture 38 causing the actuator 22 to pivot about pin 48. Simultaneously, the locking tab 46 is rotated away from aperture 40 in enclosure 20 to unlock the shield 32 so that the shield 32 may freely move. When enclosure 16 is fully inserted within enclosure 20, the shield 32 is pushed away so that the male and female connectors 34, 14 may engage. When the enclosures 16, 20 are separated, the male and female connectors 34, 14 may disengage, the shield 32 may rotate back to the closed position and the shield 32 is locked by the locking tab on actuator 22.

The unlocking of the shield and rotating out of the way occurs early enough in the insertion of enclosure 16 so the male and female connectors 34, 14 are free to float, align, and engage.

The exemplary embodiments may further include a compliant member to bring locking tab 46 back into the locked position automatically when the enclosure 16 is removed. The compliant member may be, for the purpose of illustration and not limitation, a spring such as a torsion spring or a helical spring, a compliant plastic or a hinged plastic material to provide the required compliance. For the purpose of illustration and not limitation, the compliant member as shown in FIGS. 1 and 6 to 9 is a torsion spring.

The compliant member may be used to ensure that the shield 32 returns to the closed position after the enclosure 16 is removed from the enclosure 20. The compliant member also ensures that the shield 32 closes properly, and stays closed, when the connector system 10 is turned on its side or upside down and doesn't have gravity to assist in closing the shield 32.

The shield 32 feature of the exemplary embodiments provides the touch-safe protection for the male connector 34 from the front while the enclosure 20 protects the other directions of access to the male connector 34. The shield 32 remains closed when the female connector 14 and enclosure 16 is removed from the enclosure 20 and only opens when the enclosures 16, 20 are mated together.

Figure 9:
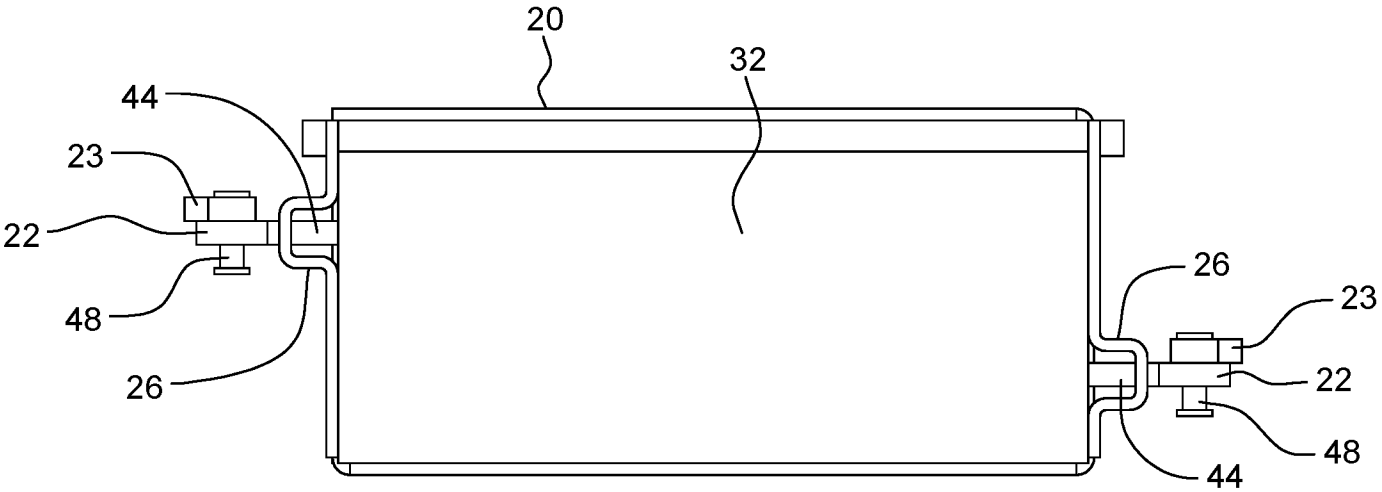
FIG. 9 illustrates an end view of the enclosure enclosing the male component showing the shield which prevents contact with the male connector and actuators which lock and unlock the shield.

FIG. 9 is an illustration of the second connector 18 looking into the second connector 18 from the front.

In a preferred exemplary embodiment, there are two actuators 22, one each on opposite sides of the enclosure 20. In order to prevent tampering or subversion of the shield 32, the actuators 22 are spaced apart linearly and in different elevation planes to minimize tampering by, for example, sliding a flat element to unlatch both locking tabs 46 at one time. By spaced apart linearly, it is meant that the actuators 22 may be on opposite sides of the enclosure 20. By being in different elevation planes, it is meant that they are at different vertical locations on the sides of the enclosure as shown in FIG. 9. By spacing apart the actuators 22 and putting them at different distances from a common reference plane, a human needs both hands to unlock the locking tabs 46 (one for each actuator 22) which leaves no hand available to manually push open the shield 32 and subvert the touch-safe characteristic of the connector system 10.

Figure 12:
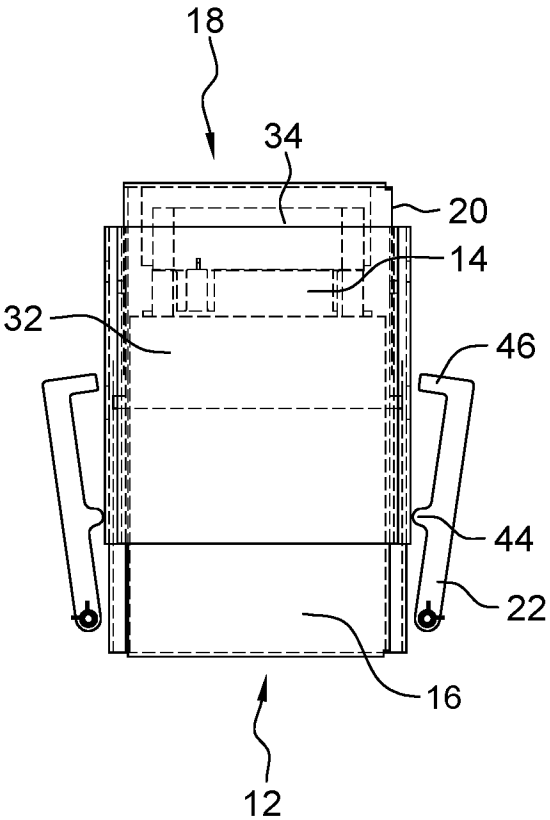
FIGS. 10, 11 and 12 illustrate the process steps of inserting the enclosure enclosing the female connector into the enclosure enclosing the male connector as shown in FIG. 10, further inserting the enclosure enclosing the female connector into the enclosure enclosing the male connector to cause the actuators to unlock the shield as shown in FIG. 10 and inserting the enclosure enclosing the female connector into the enclosure enclosing the male connector as far as possible to push the shield out of the way so as to cause the female connector and male connector to engage as shown in FIG. 12.
Figure 11:
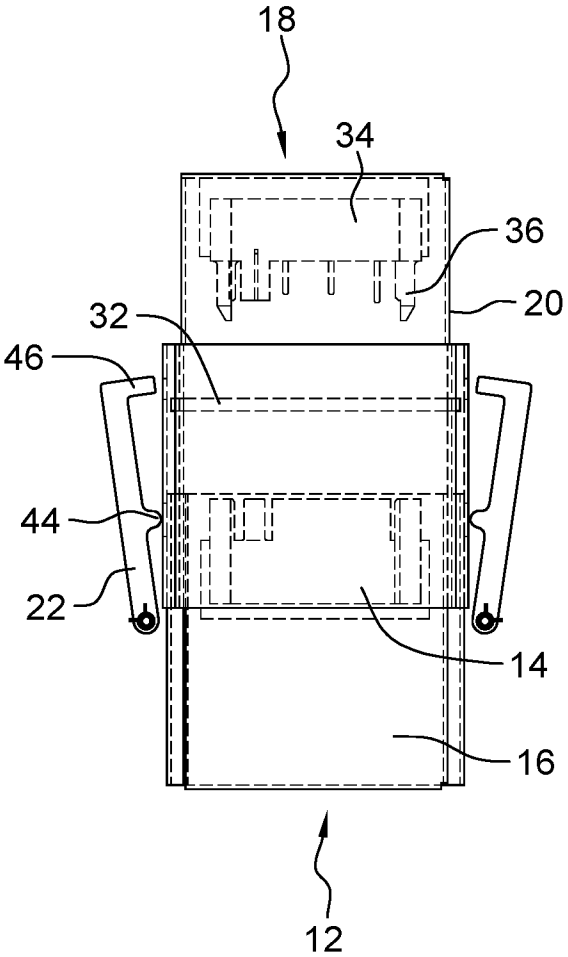
Figure 10:
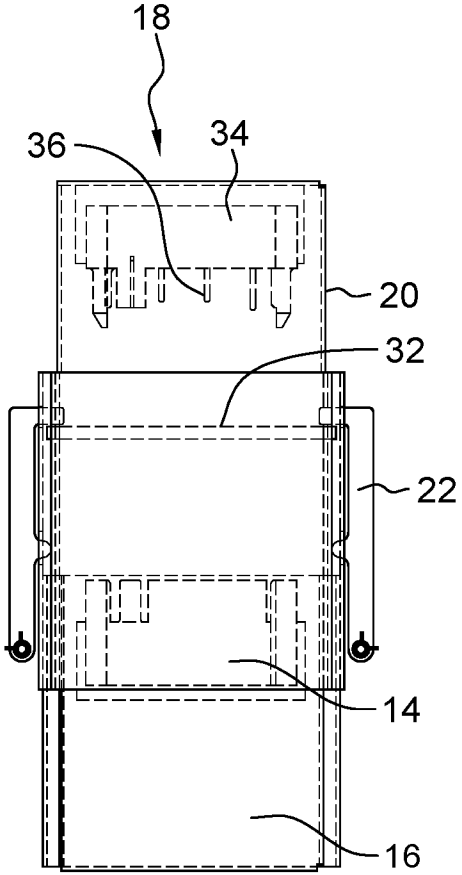

Referring now to FIGS. 10 to 12, there is illustrated the engaging of the first connector component 12 and the second connector component 18. For the purpose of illustrating the engaging process, the enclosures 16, 20 are made translucent to provide a better view of what is occurring internally.

Referring to FIG. 10, the connector component 12 is partially inserted within enclosure 20 but not far enough into the enclosure 20 so that actuating tabs 44 on actuators 22 are not actuated and therefore locking tabs 46 remain in place so that the shield 32 is locked in place and the connector system 10 is double touch-safe. Aligners 24, 26 may be used for aligning the connector components 12, 18.

In FIG. 11, connector component 12 is further inserted into the enclosure 20 so that enclosure 16 may depress the actuating tabs 44. The depression of the actuating tabs 44 causes the locking tabs 46 to rotate away from the shield 32. The shield 32 is now unlocked and may be opened while the enclosures 16, 20 protect a user from hazardous voltages.

In FIG. 12, connector component 12 is inserted all the way into the enclosure 20. The movement of the enclosure 16 within enclosure 20 pushes the shield 32 up and away. The female connector 14 and male connector 34 are free to blind mate and engage as the connector component 12 is pushed all the way into the enclosure 20.

The exemplary embodiments also pertain to a method of joining components of a connector system. The connector system 10 may include a connector component 12 that includes a female connector 14 and a connector component 18 that may include a male connector 34 having blades 36 for insertion into the female connector 14. The connector component 18 may further include an enclosure 20 enclosing the male connector 34 and having an open end such that the blades 36 of the male connector 34 face the open end, a locked shield 32 within the open end of the enclosure 20 to obscure the blades 36 and to prevent contact with the blades 36, and an actuator 22 to unlock the locked shield 32.

Figure 13:
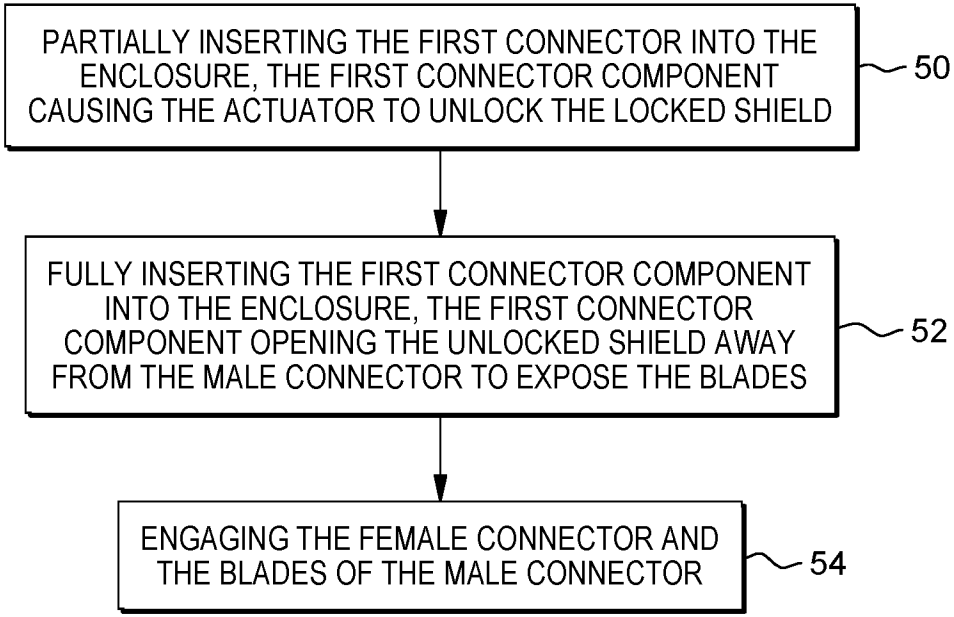
FIG. 13 is a flow chart of an exemplary embodiment for joining components of a connector system.

Referring to FIG. 13, the method includes a first step of partially inserting the first connector into the enclosure, the first connector component causing the actuator to unlock the locked shield, box 50.

Another step includes fully inserting the first connector component into the enclosure, the first connector component opening the unlocked shield away from the male connector to expose the blades, box 52.

A final step includes engaging the female connector and the blades of the male connector, box 54.

It will be apparent to those skilled in the art having regard to this disclosure that other modifications of the exemplary embodiments beyond those embodiments specifically described here may be made without departing from the spirit of the invention. Accordingly, such modifications are considered within the scope of the invention as limited solely by the appended claims.

What is claimed is:

1. A connector system comprising:

a first connector component comprising a female connector;

a second connector component comprising:

a male connector having blades for insertion into the female connector;

an enclosure enclosing the male connector and having an open end such that the blades of the male connector face the open end;

a single locked shield within the open end of enclosure to obscure the blades and to prevent contact with the blades;

a first actuator positioned on a first side of an exterior of the enclosure and a second actuator positioned on a second side of the exterior of the enclosure such that the first side and the second side are different sides of the enclosure and such that the first actuator and the second actuator must both be actuated to unlock the locked shield;

wherein, in operation, upon insertion of the first connector component into the enclosure, the first connector component causes the first actuator and the second actuator to unlock the locked shield and upon further insertion of the first connector component into the enclosure, the first connector component opens the unlocked shield away from the male connector to expose the blades and to allow the female connector to engage the blades of the male connector.

2. The connector system of claim 1 wherein upon removal of the first connector component, the unlocked shield closes and locks to revert to the locked shield.

3. The connector system of claim 1 further comprising a second enclosure enclosing the female connector and having an open end in which the female connector is exposed.

4. The connector system of claim 3 further comprising a first aligner on an exterior of the enclosure and a second aligner on an exterior of the second enclosure such that the first aligner and the second aligner are slideably engaged to cause alignment of the enclosure and the second enclosure.

5. The connector system of claim 4 wherein the first connector component and the second connector component are blind mated.

6. The connector system of claim 1 wherein the first actuator and the second actuator are spaced apart horizontally and vertically so as not to be in alignment.

7. A connector system comprising:

a male connector component comprising:

a male connector having blades for insertion into a female connector;

a first enclosure enclosing the male connector and having an open end such that the blades of the male connector face the open end;

a first aligner on an exterior of the first enclosure;

a locked shield within the open end of the first enclosure to obscure the blades and to prevent contact with the blades;

a first actuator and a second actuator positioned on an exterior of the first enclosure to unlock the locked shield, each of the first actuator and the second actuator having an actuator tab extending into the enclosure and a locking tab extending into the enclosure;

a female connector component comprising:

a female connector;

a second enclosure enclosing the female connector and having an open end in which the female connector is exposed;

a second aligner on an exterior of the second enclosure;

wherein, in operation, upon insertion of the female connector component into the first enclosure to slideably engage the first aligner with the second aligner to cause alignment of the first enclosure and the second enclosure, the second enclosure contacts the actuating tabs of the first and second actuators which causes the locking tabs of the first and second actuators to together unlock the locked shield and upon further insertion of the female connector component into the first enclosure, the second enclosure opens the unlocked shield away from the male connector to expose the blades and to allow the female connector to engage the blades of the male connector.

8. The connector system of claim 7 wherein upon removal of the female connector component, the unlocked shield closes and locks to revert to the locked shield.

9. The connector system of claim 8 wherein the male connector component and the female connector component are blind mated.

10. The connector system of claim 7 wherein the first actuator and the second actuator are on different sides of the first enclosure.

11. The connector system of claim 10 wherein actuating tabs and the locking tabs of the first actuator and the second actuator are spaced apart horizontally and vertically so as not to be in alignment.

12. A method of joining components of a connector system comprising:

a first connector component comprising a female connector; a second connector component comprising: a male connector having blades for insertion into the female connector; an enclosure enclosing the male connector and having an open end such that the blades of the male connector face the open end; a locked shield within the open end of enclosure to obscure the blades and to prevent contact with the blades; and a first actuator and a second actuator positioned on an exterior of the enclosure, each of the first actuator and the second actuator having an actuator tab extending into the enclosure to unlock the locked shield and a locking tab extending into the enclosure to lock the locked shield, the method comprising the steps of:

partially inserting the first connector into the enclosure, the first connector component pushing the actuating tabs of the first actuator and the second actuator out of the enclosure while also causing the locking tabs of the first actuator and the second actuator to be moved out of the enclosure and away from the locked shield causing the unlocking of the locked shield;

fully inserting the first connector component into the enclosure, the first connector component opening the unlocked shield away from the male connector to expose the blades;

engaging the female connector and the blades of the male connector.

13. The method of claim 12 further comprising removing the first connector component;

responsive to removing the first connector component, closing the unlocked shield and reverting to the locked shield.

14. The method of claim 12 wherein in the step partially inserting the first connector into the enclosure, the first connector component causing the locking tabs of the first actuator and the second actuator to simultaneously unlock the locked shield such that the locking tabs of the first actuator and the second actuator must both be actuated to unlock the locked shield.

* * * * *